United States Patent [19]

Meltzer

[11] 4,302,260

[45] Nov. 24, 1981

[54] SIMULATED STAINED GLASS ARTICLE AND METHOD OF MAKING SAME

[76] Inventor: Joel Meltzer, 1440 Kelton Dr., Stone Mountain, Ga. 30083

[21] Appl. No.: 6,900

[22] Filed: Jan. 26, 1979

[51] Int. Cl.[3] ..... B44F 1/06

[52] U.S. Cl. ..... 156/63; 428/38

[58] Field of Search ..... 428/38; 156/63; 52/311

[56] References Cited

U.S. PATENT DOCUMENTS

| | | | |
|---|---|---|---|
| 286,434 | 10/1883 | Herzog | 428/38 |
| 2,313,489 | 3/1943 | Latrobe | 428/30 X |
| 3,247,046 | 4/1966 | Fazekas | 156/63 X |
| 3,350,045 | 10/1967 | Mayers | 428/14 X |
| 3,400,035 | 9/1968 | Haig | 428/142 |
| 3,420,728 | 1/1969 | Haverstock | 428/139 X |
| 3,460,303 | 8/1969 | Algrain et al. | 428/38 X |
| 3,533,889 | 10/1970 | Powell | 428/38 X |
| 3,712,845 | 1/1973 | Hartung | 428/47 X |
| 3,762,987 | 10/1973 | Maruta et al. | 428/40 |
| 3,815,263 | 6/1974 | Oberwager | 428/38 X |
| 3,864,193 | 2/1975 | Frierson et al. | 428/133 |
| 3,900,641 | 8/1975 | Woodman et al. | 428/38 |
| 4,127,689 | 11/1978 | Holt | 428/151 X |
| 4,172,547 | 10/1979 | Del Grande | 428/901 X |
| 4,252,847 | 2/1981 | Del Grande | 428/38 |

*Primary Examiner*—Henry F. Epstein

*Attorney, Agent, or Firm*—Jones, Thomas & Askew

[57] ABSTRACT

An improved simulated stained glass article including pieces of textured plastic joined together by a plastic adhesive to form a realistic simulation of leaded stained glass. The article is made by cutting pieces of the textured plastic conforming to elements of a pattern, placing the pieces on a second plastic sheet, to which the textured plastic pieces removably adhere, to form the complete pattern, depositing a water-based plastic leading adhesive in the form of a bead overlapping adjacent pieces of the textured plastic, allowing the adhesive to set, and selectively removing the second plastic sheet. A craft kit for making articles according to the invention is also disclosed.

3 Claims, 8 Drawing Figures

SIMULATED STAINED GLASS ARTICLE AND METHOD OF MAKING SAME

DESCRIPTION

Technical Field

The present invention relates to a simulated stained glass article assembled from plastic materials, a method for making such an article, and a craft kit of interrelated elements used in the assembly of such a simulated stained glass article.

Background Art

For centuries, stained glass windows have been created by artisans who have joined pieces of glass of various colors and textures using actual metallic lead. Various methods of simulating such stained glass windows are now known in the prior art.

One such prior art method has involved the use of metal "dams" forming a prescribed pattern. Thereafter, crystals of different colors have been spread in the areas between the metal dams and heated to a high temperature in order to melt the crystals. Upon cooling, a rigid, simulation of a stained glass window is obtained. Such technique is limited, however, in that the texture of the surface of the fused crystals cannot be selected and shaped in order to simulate the many varying textures used in actual stained glass. Furthermore, the article is breakable and therefore potentially dangerous to persons assembling or using the simulated article.

According to a second prior art method, a single sheet of glass is overlaid with a plastic leading material and colored. Being rigid, they are also generally breakable.

Simulated stained glass articles according to a third prior art method include layers of a thermofluid or thermosetting composition built up upon a single sheet of a transparent or translucent, textured plastic material to give a leaded effect, and colored inks printed on the surface of the plastic material between the areas having the leaded effect. The disadvantages of such an article include the fact that the texture of the article is uniform throughout. Also, the attractiveness and realistic impression created by the article is limited by the fact that the color is merely an ink and does not permeate the depth of the entire article. Finally, the method of making the article is complex because of the layering of leading material required, and substantial skill is required to accurately print the surface of the plastic with ink.

It will thus be understood that prior art methods for producing simulated stained glass articles have not provided simulated articles which include pieces of plastic of various colors and various textures, the color being throughout the plastic, and the pieces being joined together by a material to give a leaded effect.

SUMMARY OF THE INVENTION

The present invention solves many of the problems associated with prior art methods of simulating stained glass by providing a simulated stained glass article wherein pieces of plastic are joined together by a plastic adhesive to form a realistic simulation of stained glass. The plastic pieces are colored throughout their depth, can be of varying textures, and have long term color stability in direct sunlight. The plastic adhesive provides a leaded effect and also permanently bonds the pieces of plastic together.

As disclosed herein, a simulated stained glass article according to the invention comprises a plurality of colored, translucent or transparent, flat, plastic members, said members being textured on at least one major surface thereof and positioned adjacent to one another, and an adhesive deposited onto the members in beaded form overlapping adjacent members to permanently bond the adjacent members and give a leaded effect. The plastic members preferably comprise polyvinyl chloride and are preferably smooth on their other major surface, so that the completed article will removably adhere to smooth glass. Thus, an article according to the invention may provide a simulated stained glass window ornament adhering directly to the window itself.

The method of making a simulated stained glass article according to the invention comprises the steps of laying a transparent sheet of a first plastic over a master pattern on a flat surface; placing a plurality of pieces of a second transparent or translucent plastic conforming to the pattern onto the sheet of first plastic, adjacent to one another, the second plastic being textured on the upper surface thereof and removably adhering to the sheet of first plastic; depositing an adhesive onto the textured upper surface of the pieces of the second plastic overlapping adjacent pieces to form a leaded effect, the adhesive permanently bonding to the adjacent pieces of the second plastic and not bonding to the first plastic sheet; allowing the adhesive to set, and then removing the sheet of first plastic from the joined pieces of the second plastic.

A craft kit for making the simulated stained glass articles according to the invention includes a matter pattern drawn on a flat sheet, at least one sheet of translucent or transparent plastic, textured on one surface thereof and smooth on the other surface thereof, a plurality of secondary patterns drawn on flat sheets, each representing elements of the master pattern to be cut from the plastic sheet, a sheet of polyethylene film adapted to be placed over the master pattern to receive and removably adhere to the smooth surface of the plastic elements which are placed on the film according to the master pattern, and a supply of adhesive for application to the textured surface of adjacent plastic elements to give a leaded effect and to permanently bond to the plastic elements but not to the polyethylene film.

It will thus be seen that a simulated stained glass article according to the present invention provides a highly realistic simulation of actual stained glass because separate pieces of plastic of varying textures and varying colors may be permanently bonded together to simulate the common practice in actual stained glass of combining glass of varying colors and varying textures. Unlike actual stained glass, however, an article according to the invention is flexible, lightweight, unbreakable, and capable of removably adhering to a smooth glass surface for display without use of adhesives. Furthermore, the method of the invention provides a relatively clean and simple process for assembling an article according to the invention.

Thus, it is an object of the present invention to provide a realistic simulated stained glass article.

It is a further object of the present invention to provide a simulated stained glass article wherein plastic pieces of varying colors and textures are joined together by a plastic adhesive to simulate actual stained glass.

It is a further object of the present invention to provide a method of making a simulated stained glass article wherein pieces of plastic sheets of varying colors and textures are held in place over a pattern by adherence to a film or another plastic while a plastic leading material is applied to the upper surface of adjacent plastic pieces to bond the pieces together.

It is a further object of the present invention to provide a craft kit containing interrelated elements for making a simulated stained glass article according to the invention.

Other objects, features and advantages of the present invention will become apparent upon reading the following specification when taken in conjunction with the accompanying drawing.

DETAILED DESCRIPTION

Figure 1:
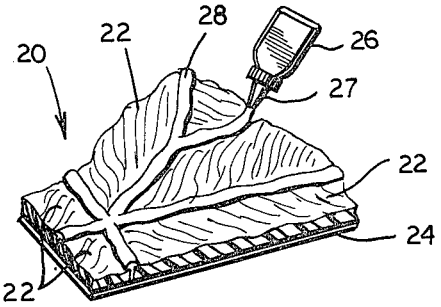
FIG. 1 is a pictorial view of a portion of a simulated stained glass article according to the invention, showing leading material being applied.

Referring now in more detail to the drawing, in which like numerals indicate like elements throughout the several views, FIG. 1 is a partial pictorial view of a simulated stained glass article 20 according to the present invention. The article 20 includes a plurality of flat pieces of polyvinyl chloride 22 placed adjacent to one another on a thin polyethylene film 24. The polyvinyl chloride pieces 22 are textured on the upper major side thereof and smooth on the lower major side, which removably adheres to the polyethylene film 24 without the use of an adhesive. The texturing and color of the polyvinyl chloride pieces 22 can vary, and the article 20 can be made up of any selected combination of textures and colors. A plastic leading material or adhesive 28 is applied to the textured surface of the polyvinyl chloride pieces 22, overlapping a portion of adjacent polyvinyl chloride pieces. The leading 28 is applied in a flowable form from a squeeze bottle 26 which includes a spout 27 to control the amount of leading material 28 deposited on the polyvinyl chloride. The leading material 28 forms a bead where it joins the adjacent pieces of polyvinyl chloride 22, to give a raised leaded effect, and also flows between the adjacent pieces.

Although in the preferred embodiment just described, the polyvinyl chloride pieces are textured on one major surface thereof and smooth on the other major surface thereof, it is within the concept of the invention for the article 20 to include polyvinyl chloride pieces 22 wherein both major surfaces are textured. In such an embodiment, the polyethylene film 24 is not included because it will not readily adhere to a textured polyvinyl chloride surface.

The polyvinyl chloride utilized to form the pieces 22 is reinforced with ultraviolet inhibitors to prevent yellowing of the polyvinyl chloride upon exposure to sunlight, and also includes coloring pigments which include stabilizers to prevent deterioration of the color upon exposure to sunlight. The pigments are also fixed in the polyvinyl chloride to prevent migration between pieces of different colors. Treatment of the polyvinyl chloride and pigments with inhibitors and stabilizers is done according to methods known to those skilled in the art. A suitable product is manufactured by Intervinyls Corporation. Opalescent coloring can be utilized as well as colorings giving a clear appearance.

The polyvinyl chloride sheets from which the pieces 22 are obtained are preferably manufactured by an extrusion process. Texturing on one or both sides of the polyvinyl chloride is produced by extruding the plastic using one or two textured rollers. It will thus be seen that the polyvinyl chloride may be extruded having any of a variety of textures such as rough or fine random texturing, a rippled effect, a ribbed effect or the like. In lieu of rollers, texturing may be provided by extruding the plastic material through fixed extrusion heads of various configurations. Alternately, the polyvinyl chloride may be formed using a plastisol method whereby the plastic material is placed in an open mold and heated in an oven. The plastisol method produces a random texturing on the upper surface of the plastic. Such methods of producing polyvinyl chloride sheets are well known to those skilled in the art.

The leading material or adhesive 28 exists as a thick, cohesive liquid within the squeeze bottle 26. When squeezed through the spout 27 onto the polyviny chloride pieces 22, the leading material 28 sets after a period of time and permanently bonds to the polyvinyl chloride. The leading material 28 can be a water based polymer which dries and sets upon exposure to air. The preferred leading material is a non-toxic, water-based synthetic resin manufactured by H. B. Fuller & Company under the designation "Fuller's 100-10-16". Such product has a higher degree of adhesion to polyvinyl chloride than water based leading materials used in the prior art methods described above. Whereas such prior art leading materials can be peeled off a polyvinyl chloride surface, the leading material of the present invention permanently bonds to the polyvinyl chloride and cannot be peeled off without leaving some leading material bonded to the polyvinyl chloride. Since the leading material 28 is water-based, it sets upon exposure to air and does not require heating in an oven or any other special environmental conditions for setting.

The film 24 is preferably of polyethylene because polyethylene removably adheres to a smooth polyvinyl chloride surface, but does not bond to the leading material 28 just described during the normal setting time of the leading material. This allows the polyethylene film to retain the polyvinyl chloride pieces 22 in position during the application of the leaded material 28, but further allows the polyethylene film to be peeled away from the back of the article 20 when the leading material 28 has set, so that the article may be adhered to a glass surface such as a window, as described below.

While the preferred embodiments of the polyvinyl chloride pieces 22, the leading material 28 and the film 24 have been described in detail herein, it should be understood that other plastic materials having the same properties and cooperating in the same manner may be utilized to construct a simulated stained glass article within the concept of the present invention. For example, if a plastic other than polyvinyl chloride were utilized to form the pieces 22, a leading material 28 within the concept of the invention would be one which would give a leaded effect and permanently bond to such plastic. Likewise, a film material 24 within the concept of the invention would be one which would removably adhere to such plastic material but which would not bond to such leaded material.

Figure 2:
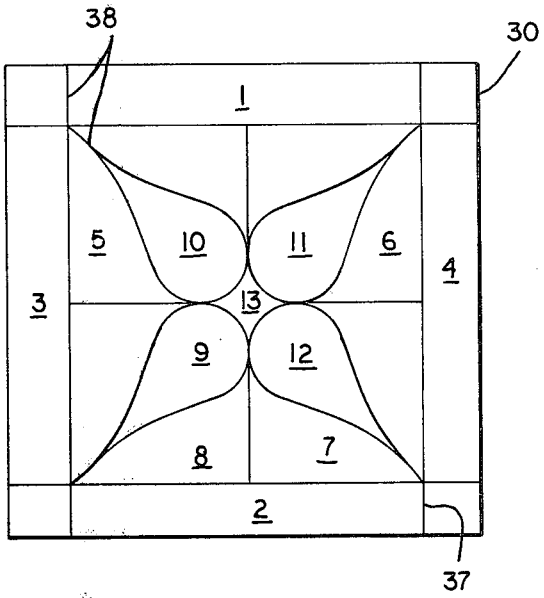
FIG. 2 is a representation of a master assembly pattern used in assembling a simulated stained glass article according to the invention.
Figure 3:
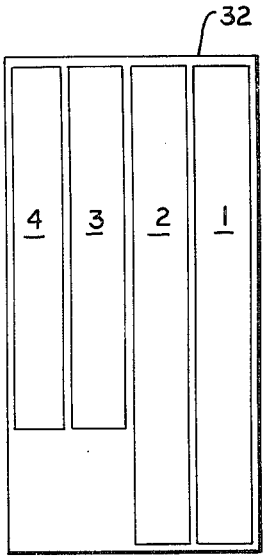
FIGS. 3–6 represent secondary patterns for tracing the elements of the master assembly pattern of FIG. 2 onto sheets of plastic material of various colors.
Figure 4:
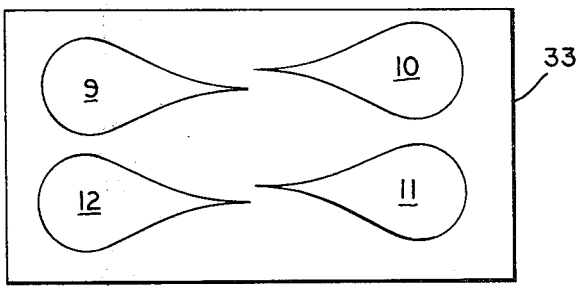
Figure 5:
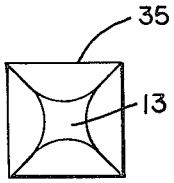
Figure 6:
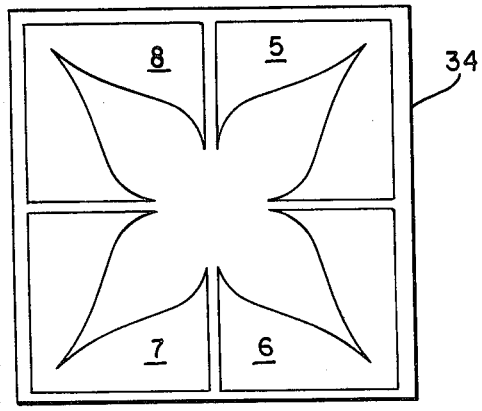

A person carrying out the method of the present invention to assemble a simulated stained glass article such as shown in FIG. 1 utilizes a master assembly pattern 30, as shown in FIG. 2, and a plurality of secondary patterns 32, 33, 34 and 35, as shown in FIGS. 3–6. Both the master assembly pattern 30 and the secondary patterns 32–35 are solid line drawings on a flat surface such as paper. The drawn lines on the master assembly pattern 30 define pattern elements which are numbered 1–13 on the master assembly pattern shown in FIG. 2. Each of the secondary patterns 32–35 defines pattern elements identical to those elements of the master assembly pattern which are to be of the same color and texture. The elements drawn on the secondary patterns 32–35 bear the same numbers as the corresponding element of the master assembly pattern 30. When the polyvinyl chloride material that is to be used to form the elements of the simulated stained glass article 20 is smooth on one side, the pattern elements drawn on the secondary patterns 32–35 are preferably drawn as mirror images of the corresponding elements on the master assembly pattern, so that tracing onto the polyvinyl chloride material may be done on the smooth side thereof, as described below.

The next step in assembling the article 20 is to trace each of the secondary pattern elements onto a sheet of polyvinyl chloride material of approximately the same size as the particular secondary pattern. If the polyvinyl chloride is smooth on one side and the pattern elements on the secondary patterns are mirror images of the elements on the master assembly pattern, the polyvinyl chloride sheet can be placed textured side down on the secondary pattern. Then the pattern elements can be traced using a ballpoint pen or a crayon, which writes easily and accurately on the smooth surface. The traced pattern elements can then be cut out of the sheets of polyvinyl chloride using, for example, an ordinary pair of household scissors. The precision of cutting and tracing need not be exact because irregularities are hidden by the leading material 28. The traced pieces 22 can be cut out one at a time and assembled as hereinafter described, or each sheet can be completely cut at the same time and the pieces numbered with an erasable marker.

Figure 7:
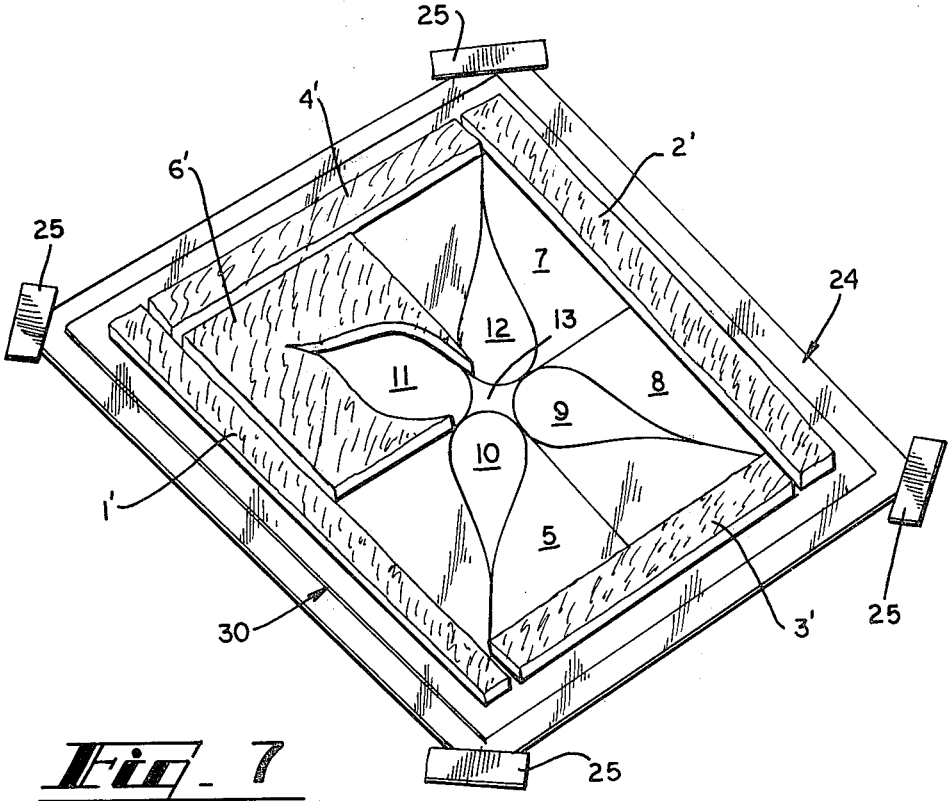
FIG. 7 is a pictorial view of a partially assembled simulated stained glass article according to the invention.

In order to assemble the polyvinyl chloride pieces 22, the master assembly pattern 30 is stretched flat and taped or otherwise fixed to a flat surface, as shown in FIG. 7. Thereafter, a sheet of polyethylene film 24 is stretched taut to completely cover the master assembly pattern, and the film is also taped at its corners with pieces of tape 25 or otherwise fixed to the flat surface. At this point, the master assembly pattern 30 is clearly visible through the transparent polyethylene film 24. The polyvinyl chloride pieces 22 corresponding to pattern elements (for example 1'–4' and 6' in FIG. 7) can now be taken and pressed, smooth side down and textured side up, onto the polyethylene sheet in a position covering the corresponding pattern element. FIG. 7 shows an article according to the invention is a partial stage of assembly, with several polyvinyl chloride pieces pressed in place. Because the polyethylene film is stretched tight, the smooth surface of the polyvinyl chloride will adhere to the polyethylene film and thus be maintained in position until the entire article 20 is assembled. It is advisable to begin with placement of the border pattern elements, shown as 1, 2, 3, and 4, in FIG. 2, and thereafter gradually move toward the center of the master assembly pattern 30. This assures that the shape of the article when finished will be as desired. If pieces 22 that have been previously cut out do not fit accurately, they can be trimmed to fit as necessary.

After all of the pieces 22 corresponding to all of the pattern elements 1–13 of the master pattern 30 have been placed on the polyethylene film 24, the leading adhesive 28 can be applied. The leading adhesive 28 is applied by squeezing a bead of material from the squeeze bottle 26 through the spout 27 and moving the bottle 26 along the joints between adjacent pieces 22 at a rate sufficient to deposit a bead of leading adhesive 28 onto the joint overlapping each adjacent piece 22. When drawn lines on the master assembly pattern 30 indicate leading between areas of the same color and texture, the entire element may be cut out of a polyvinyl chloride sheet and the desired leading material may be deposited on top of the polyvinyl chloride. Such lines are indicated by the reference numeral 38 on FIG. 2.

The leading adhesive 28 is preferably of a consistency wherein it does not drip and furthermore "melts" together with previously deposited leading material when a bead of leading must be started midway along the length of a previously applied bead. The leading adhesive 28 is also highly cohesive, so that it provides a three-dimensional leaded effect above the textured surface of the polyvinyl chloride pieces 22, although it flows between the adjacent polyvinyl chloride pieces 22. The leading adhesive 28 permanently bonds to each adjacent polyvinyl chloride piece 22, but does not bond to the polyethylene sheet 24. Being water-based, the leading adhesive 28 dries and sets, bonding to the polyvinyl chloride pieces, in about eight hours. When the leading adhesive 28 has set, the polyethylene sheet 24 may be peeled off of the simulated stained glass article 20 if desired. At this point the leading adhesive which was adjacent to the polyethylene film may require a further brief drying period.

If it is desired to utilize the completed simulated stained glass article as a window ornament, the smooth back side of the article may be cleaned with a mild detergent and water, and dried thoroughly. A window may then be cleaned using any household window cleaner, and, after such cleaning, the smooth side of the polyvinyl chloride will removably adhere directly to the glass.

Figure 8:
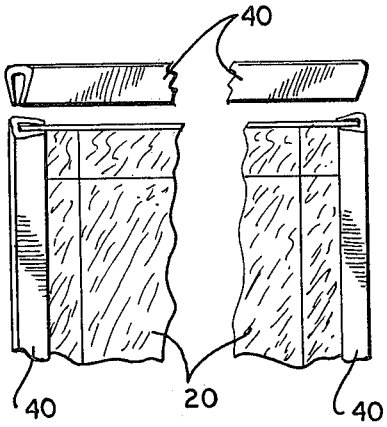
FIG. 8 is a diagrammatic pictorial view showing framing members slidably engaging the edges of a simulated stained glass article according to the invention, with one such framing member shown in an exploded position.

Alternatively, if it is desired to provide a frame for the simulated stained glass article, a frame may be slidably mounted onto the edges of the article 20, utilizing flexible framing members 40 as shown in FIG. 8. The framing members 40 are formed of a resilient plastic material in the shape of a "C". The framing members 40 may be opened out from a normal position and caused to slidingly engage the edges of the article 20, the resilient nature of the material causing the framing members 40 to clamp onto the article 20. In a preferred embodiment, a rectangular simulated stained glass article is framed by thus placing two framing members 40 on opposite parallel sides of the article 20 and thereafter placing another pair of framing members 40 onto the opposite sides of the article 20 by slidingly engaging the latter pair of framing members 40 over both the article 20 and the ends of the framing members 40 already engaging the article 20. The framing members 40 are thus clamped to each other by their resilient force, as well as to the article 20, to provide a rigid, attractive frame structure.

It is possible, when the leading adhesive 28 applied to the upper surface of the polyvinyl chloride pieces 22 has set, to also place leading adhesive 28 along the joints on the lower side of the polyvinyl chloride pieces 22. This would be done primarily for the sake of appearance, particularly if the polyvinyl chloride pieces 22 are textured on both sides. However, applying the leading adhesive 28 to the joints on both sides is not necessary in order to permanently bond the pieces together.

In order to give the normally black leading material 28 an "aged"appearance, similar to actual lead, it may be gone over with a grey or silver crayon after setting.

A craft kit according to the invention includes interrelated articles needed to practice the method of the present invention as just described. Such elements include a master assembly pattern 30, a plurality of secondary patterns 32–35, a plurality of polyvinyl chloride sheets textured on at least one major surface thereof and onto which pattern elements may be traced from the secondary patterns 32–35, a sheet of polyethylene film 24, for retaining the polyvinyl chloride pieces cut out according to the secondary patterns, and a supply of leading adhesive 28 in a squeeze bottle 26, or in an equivalent means for applying the leading adhesive 28. A plurality of framing members 40 can also be included, and a crayon for marking polyvinyl chloride pieces and going over the set beads of leading material.

It will be seen from the foregoing that the method of the present invention and the simulated stained glass article resulting therefrom provide a more realistic stained glass article than was possible using prior art methods for simulating stained glass. In particular, the present invention allows a plurality of textures and a plurality of colors to be combined in a single simulated stained glass article. Such advantages are possible because the present invention provides, for the first time, a plastic simulated stained glass article wherein individual plastic pieces are cemented together with an adhesive which permanently bonds to the plastic pieces and provides a raised leaded effect.

While this invention has been described in detail with particular reference to preferred embodiments thereof, it will be understood that variations and modifications can be effected within the spirit and scope of the invention as described hereinbefore and as defined in the appended claims.

What is claimed is:

1. A method of making a simulated stained glass article comprising the steps of:

laying a transparent film of a first plastic over a master pattern on a flat surface;

placing a plurality of pieces of a second transparent or translucent plastic conforming to said pattern onto said film adjacent to one another, said second plastic being textured on the upper surface thereof and removably adhering to said film;

depositing an adhesive onto said textured upper surface of said pieces of said second plastic between and overlapping adjacent pieces to form a leaded effect, said adhesive permanently bonding to said second plastic and not bonding to said first plastic;

allowing said adhesive to set; and removing said film from said pieces of said second plastic.

2. The method of claim 1 wherein said master pattern includes a plurality of elements to be matched by pieces of said second plastic; and wherein said method includes the steps of tracing secondary patterns onto sheets of said second plastic, each of said secondary patterns portraying elements of said master pattern, and cutting said sheets of said second plastic into shapes conforming to said pattern elements.

3. The method of claim 1 wherein said first plastic comprises polyethylene and said second plastic comprises polyvinyl chloride.

* * * * *